US007895956B2

(12) United States Patent
O'Connor

(10) Patent No.: US 7,895,956 B2
(45) Date of Patent: Mar. 1, 2011

(54) ROLL-OFF FIREBOX APPARATUS

(75) Inventor: Brian M. O'Connor, Palm City, FL (US)

(73) Assignee: Air Burners LLC, Palm City, FL (US)

( * ) Notice: Subject to any disclaimer, the term of this patent is extended or adjusted under 35 U.S.C. 154(b) by 425 days.

(21) Appl. No.: 12/038,032

(22) Filed: Feb. 27, 2008

(65) Prior Publication Data

US 2009/0211501 A1 Aug. 27, 2009

(51) Int. Cl.
*F23G 5/40* (2006.01)
*B60P 1/64* (2006.01)

(52) U.S. Cl. ..... 110/241; 414/500

(58) Field of Classification Search ..... 414/500; 110/241; 294/68.1, 68.2
See application file for complete search history.

(56) References Cited

U.S. PATENT DOCUMENTS

| | | | | |
|---|---|---|---|---|
| 3,880,072 | A * | 4/1975 | Ord | 414/494 |
| 4,372,726 | A * | 2/1983 | Lutz | 414/517 |
| 4,529,349 | A * | 7/1985 | Lutz | 414/478 |
| 4,645,405 | A * | 2/1987 | Cambiano | 414/494 |
| 4,756,258 | A | 7/1988 | Gilbert | |
| 4,840,532 | A * | 6/1989 | Galbreath | 414/479 |
| 5,415,113 | A * | 5/1995 | Wheeler et al. | 110/241 |
| 6,536,360 | B2 | 3/2003 | O'Connor | |
| 6,766,750 | B2 | 7/2004 | O'Connor | |
| 7,004,088 | B2 | 2/2006 | Ford | |
| 7,063,027 | B2 | 6/2006 | O'Connor | |
| 7,318,611 | B2 * | 1/2008 | Estes | 414/498 |
| 2007/0144412 | A1 | 6/2007 | O'Connor | |

* cited by examiner

*Primary Examiner*—Kenneth B Rinehart
*Assistant Examiner*—David J Laux
(74) *Attorney, Agent, or Firm*—Hodgson Russ LLP

(57) ABSTRACT

A firebox apparatus is adapted for transport on a vehicle having a roll-off hoist mechanism by providing parallel guides on the underside of a supporting skid assembly of the firebox apparatus for engaging siderails of a tiltable roll-off track of the hoist mechanism, and by providing reinforced front and rear portions connecting parallel longitudinal skid members to maintain an opening at the bottom of the firebox apparatus yet make the firebox apparatus sufficiently sturdy to withstand loads encountered during loading an unloading from the transport vehicle. The firebox apparatus includes an air curtain system for limiting pollution resulting from incineration of waste. The present invention enables easy installation and removal of the firebox apparatus in crowded environments, such as urban environments, to cleanly burn waste.

13 Claims, 6 Drawing Sheets

ROLL-OFF FIREBOX APPARATUS

FIELD OF THE INVENTION

The present invention relates to the field of waste disposal, and in particular waste disposal by incineration.

BACKGROUND OF THE INVENTION

Incinerating waste is a known alternative to burying waste or transporting it to another location. In order to reduce ash and smoke released during waste incineration (particulate release), a flow of high velocity air has been used to provide an "air curtain" over a fire pit or firebox in which the waste is burned. U.S. Pat. Nos. 4,756,258 and 5,415,113 describe portable apparatus for air curtain incineration. The former patent teaches a fan and manifold assembly that can towed to the edge of a fire pit, such as may be found at a landfill site. The latter patent teaches a firebox apparatus including a fan and manifold assembly mounted on a support skid for transport on a flatbed truck to a desired site, for example a development site where vegetation is being cleared.

Neither of the portable solutions mentioned above is suitable for use in a congested urban environment. The apparatus of U.S. Pat. No. 4,756,258 requires a fire pit, something which is not available or readily provided in an urban setting where subterranean utility infrastructure is covered by pavement or concrete. The apparatus of U.S. Pat. No. 5,415,113 must be lifted from and loaded onto a flatbed truck by a crane or lift, making it difficult and disruptive to install in crowded or confined locations.

U.S. Pat. No. 7,063,027 discloses a portable air-curtain incinerator that suffers the same portability drawback as the incinerator disclosed in U.S. Pat. No. 5,415,113.

What is needed is a portable firebox apparatus that loads onto and unloads from a transport vehicle having a conventional tiltable roll-off hoist and tension cable, such that the firebox apparatus may be transported to an urban environment and unloaded in a confined space, and later loaded back onto the transport vehicle, with relative ease.

SUMMARY OF THE INVENTION

It is therefore an object of the present invention to provide a firebox apparatus that is capable of being loaded onto and unloaded from a transport vehicle equipped with a roll-off hoist mechanism of a type having a retractable tension cable and a tiltable roll-off track.

The object is achieved by a firebox apparatus generally comprising a firebox including a pair of laterally-spaced longitudinal side walls connected by a front wall and a rear wall to define a combustion chamber having an open bottom and an open top; and a frame for supporting the walls of the firebox, the frame including a skid assembly at a base of the frame, wherein the skid assembly includes a pair of laterally-spaced longitudinal skid members connected by a front portion and a rear portion to define an internal opening registering with the open bottom of the combustion chamber, and a pair of parallel guides fixed to at least one of the front portion and the rear portion for guiding the firebox apparatus as the firebox apparatus travels in a longitudinal direction relative to the roll-off track of the transport vehicle. In an embodiment depicted herein, a pair of parallel guides are fixed to the front portion of the skid assembly and another pair of parallel guides are fixed to the rear portion of the skid assembly.

The front portion of the skid assembly may include a pair of laterally-spaced cylindrical rollers journalled at a forward location of the front portion to rotate about a transverse axis to rollingly engage respective upwardly facing surfaces of the roll-off track's siderails.

The firebox apparatus of the present invention further comprises an air curtain system for blowing air across the open top of the combustion chamber. A control room provided atop the front portion of the skid assembly houses a control unit for operating a blower in communication with a manifold arranged along the top of a longitudinal side wall of the firebox, whereby an air curtain may be generated.

The present invention extends to a method of transporting a firebox apparatus to and from an incineration location, the firebox apparatus including a firebox defining a combustion chamber having an open top, and an air curtain system adjacent the firebox for blowing air across the open top of the combustion chamber, the method comprising the steps of parking a transport vehicle endwise adjacent to the firebox apparatus, the transport vehicle including a hoist mechanism having a retractable tension cable and a tiltable roll-off track; attaching the retractable tension cable to the firebox apparatus; operating the hoist mechanism to pull the firebox apparatus onto the tiltable roll-off track; driving the transport vehicle to the incineration location; and operating the hoist mechanism to unload the firebox apparatus from the tiltable roll-off track onto the ground at the incineration location.

BRIEF DESCRIPTION OF THE DRAWING FIGURES

The nature and mode of operation of the present invention will now be more fully described in the following detailed description of the invention taken with the accompanying drawing figures, in which.

DETAILED DESCRIPTION OF THE INVENTION

Figure 1:
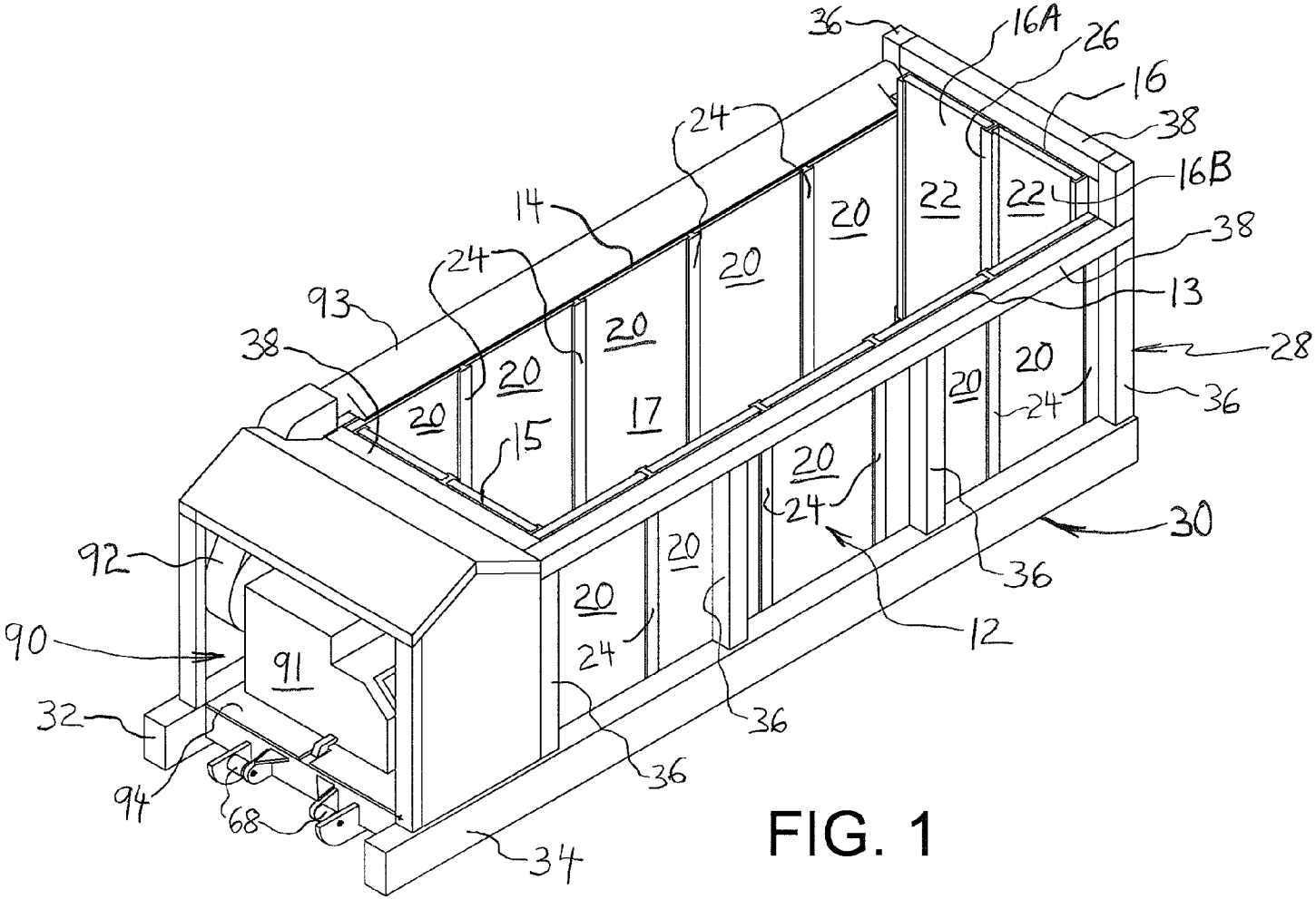
FIG. 1 is an orthogonal view of a roll-off firebox apparatus formed in accordance with an embodiment of the present invention.
Figure 2:
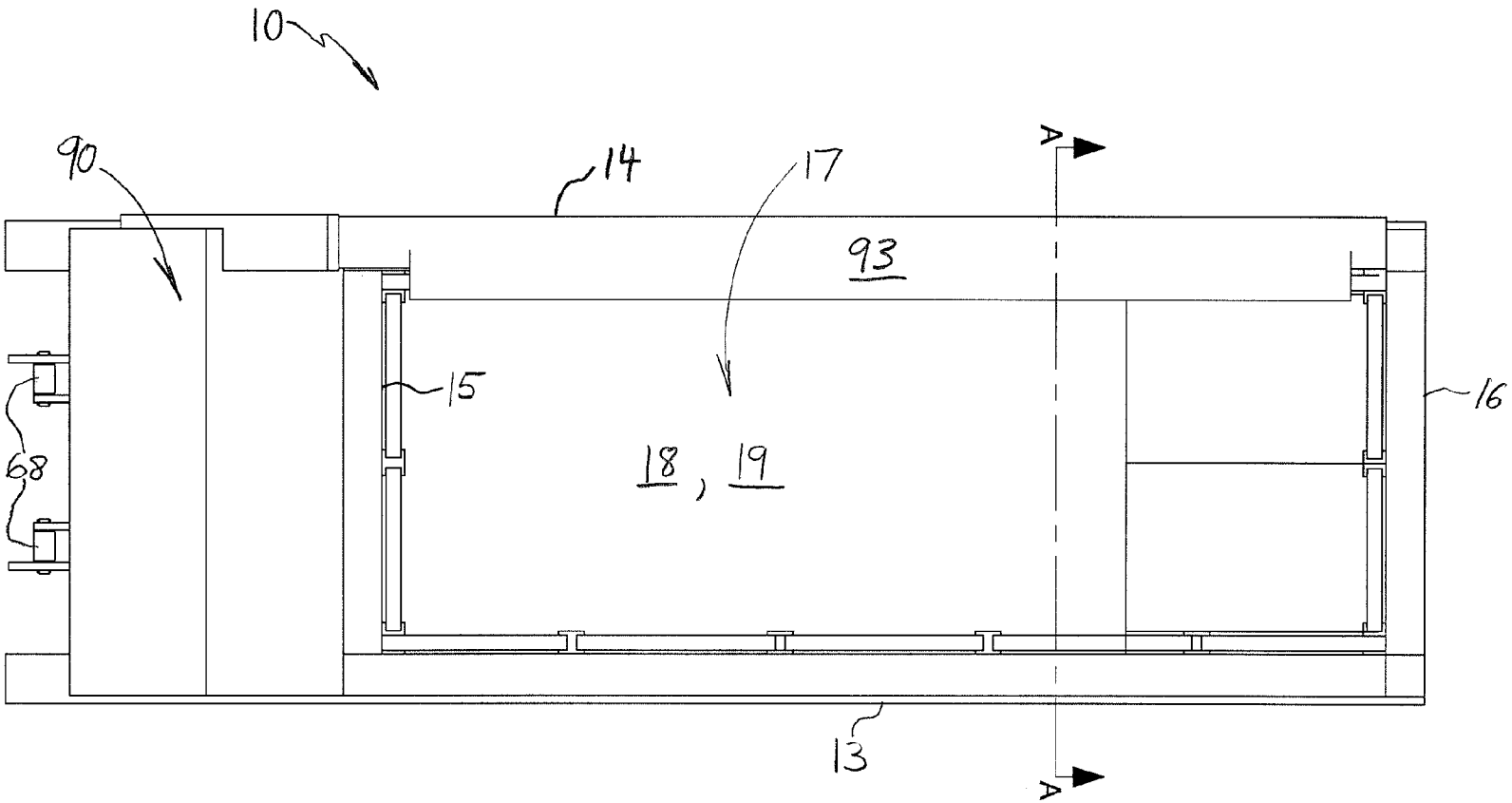
FIG. 2 is a top plan view of the roll-off firebox apparatus shown in FIG. 1.
Figure 3:
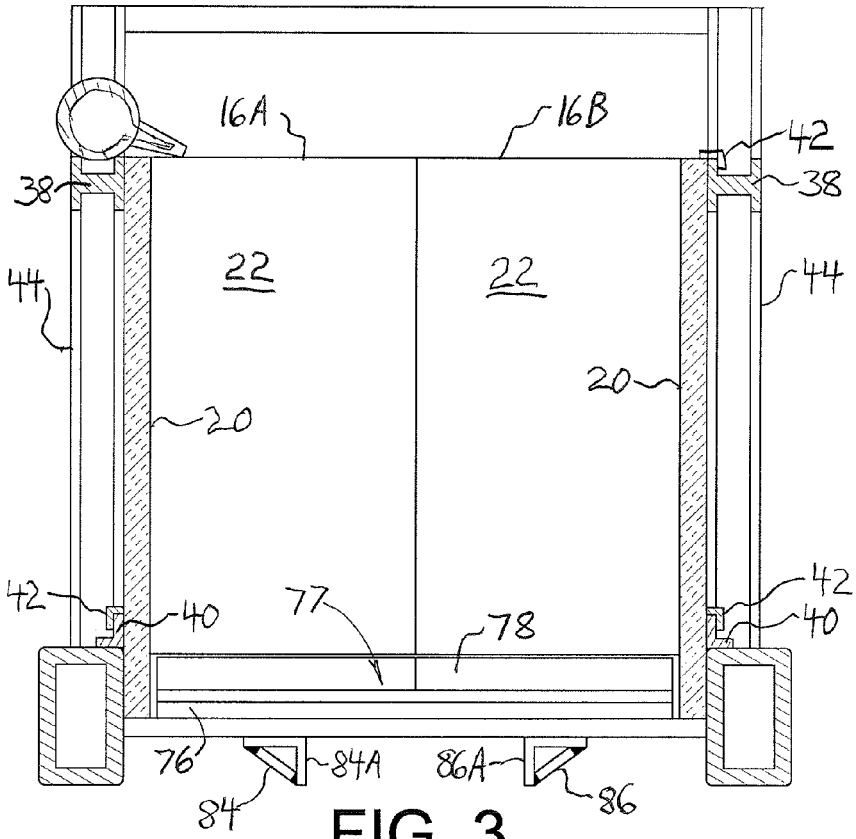
FIG. 3 is cross-sectional view of the roll-off firebox apparatus taken generally along the line A-A in FIG. 2.

A roll-off firebox apparatus 10 formed in accordance with an embodiment of the present invention is shown in FIGS. 1-4. Apparatus 10 generally comprises a firebox 12 having a pair of longitudinal side walls 13 and 14, a front wall 15 and a rear wall 16 cooperating to define a combustion chamber 17 having and open top 18 and an open bottom 19. Rear wall 16 may be formed by double doors 16A and 16B which are each hinged along one side to open outwardly. During incineration, the ground effectively forms the bottom of combustion chamber 17. Each wall 13-15 is lined on the inside with a layer of refractory material in the form of refractory panels 20. The inside of each door 16A, 16B is similarly lined with a refractory panel 22. Each panel 20, 22 includes a steel sub-frame 24, 26 thereabout. The firebox structure described above may be manufactured as taught in commonly-owned U.S. Pat. No. 5,415,113, which is incorporated herein by reference in its entirety.

Each panel/sub-frame 20/24 forming walls 13-15 and each panel/sub-frame 22/26 forming doors 16A, 16B is supported by a frame 28 of suitable strength. Frame 28 includes a skid assembly 30 at its base. Skid assembly 30 has a pair of laterally-spaced longitudinal skid members 32 and 34 connected by a front skid portion 46 and a rear skid portion 48.

Skid members 32, 34 may each be made of a length of 8"×10" rectangular steel tubing having a wall thickness of ½" for durability and longevity. The ends of skid members 32, 34 may be closed by welding a ½" thick plate over each end. Vertical and horizontal support members 36 and 38 for the refractory panels 20 may be fabricated with W6×25# wide flange I-beams. Each of the panels 20 is held in place at its top to the web of its corresponding horizontal I-beam 38 by at least two ⅜" steel clips 42. A length of 2½"×⅜" angle bar 40 is welded along the top of each skid member 32, 34 for receiving at least two such clips 42 fixed near the bottom of each panel 20. A ¼" gap is left between the panels 20 to accommodate expansion and contraction from the generated heat. Lengths of ¼"×2" flat bar are welded respectively to the back of each panel 20 to cover this ¼" gap. Each door 16A, 16B is hung from another vertical support member 44, made from a W8×31# wide flange I-beam, using four hinge mounts, made out of ½" steel plate, welded into the web of its vertical beam 44. All vertical support members 36 and 44 are secured in place with 3"×4.1# channel gussets at both the top and bottom.

Figure 5:
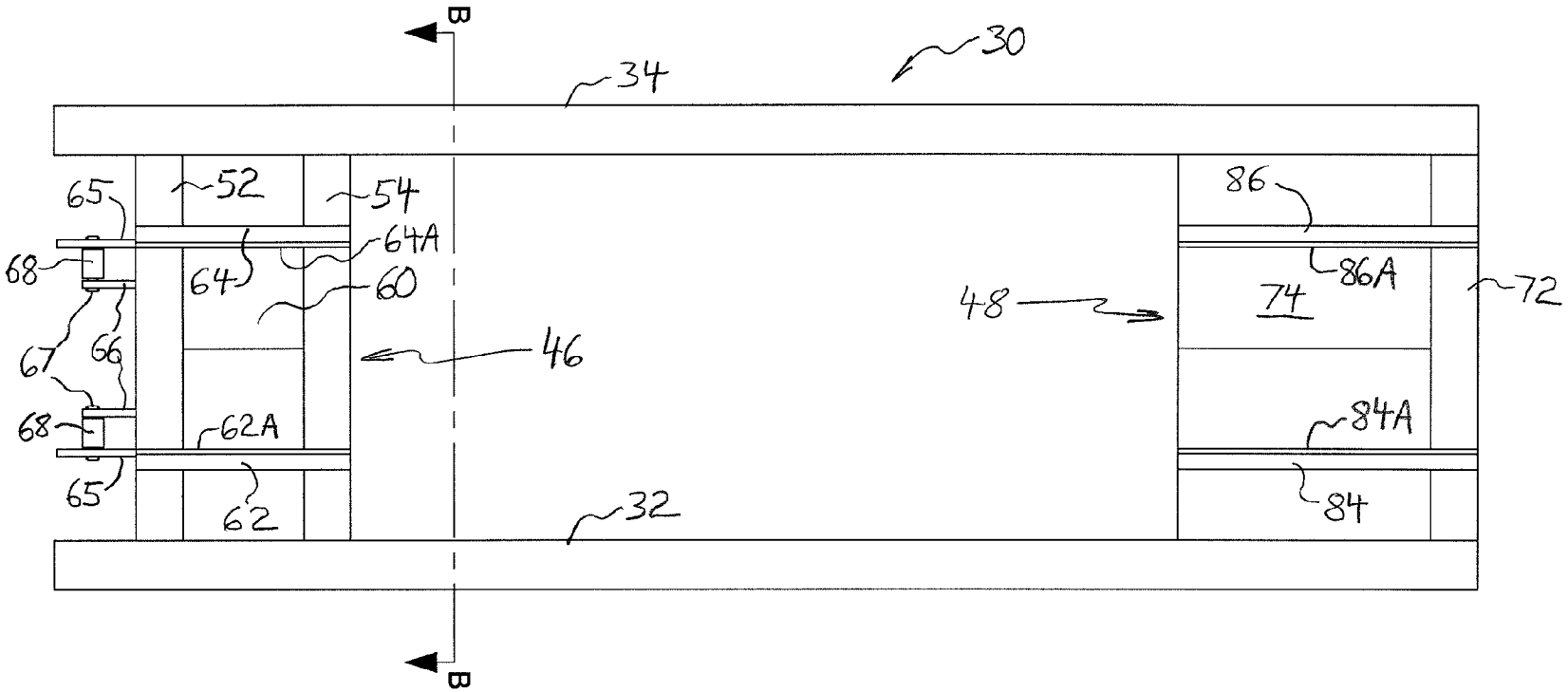
FIG. 5 is a bottom plan view of the supporting skid assembly shown in FIG. 4.
Figure 6:
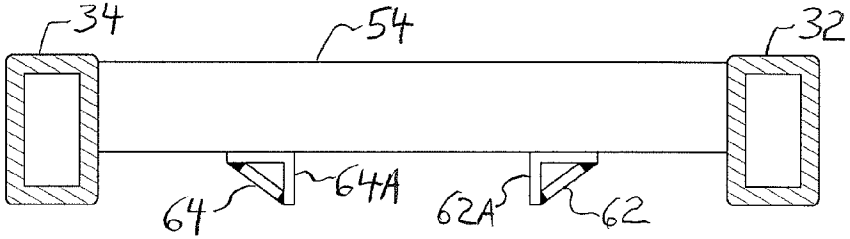
FIG. 6 is cross-sectional view of the a supporting skid assembly taken generally along the line B-B in FIG. 5.

Reference is also made now to FIGS. 5 and 6 of the drawings. Skid assembly 30 includes front portion 46 and rear portion 48 extending laterally to connect skid members 32, 34 to one another. As may be understood, skid members 32, 34 and front and rear portions 46, 48 cooperate to define an internal opening 50 registering with the open bottom 19 of combustion chamber 17.

In the embodiment shown, front portion 46 includes a pair of longitudinally-spaced cross-members 52, 54 each having its opposite ends welded to the inner side faces of skid members 32, 34. Cross-members 52, 54 may be fabricated from lengths of 8" square steel tubing. A pair of intermediate brace members 56, 58 may be arranged to extend in the longitudinal direction of skid assembly 30. Brace members 56, 58 may be formed from lengths of structural steel I-beam and/or channel stock and situated such that a lower flange of each brace member is offset just above the bottom faces of cross-members 52, 54. Front portion further includes a bottom plate 60 welded to the lower flanges of brace members 56, 58, such that a downwardly facing surface of bottom plate 60 is flush with the bottom faces of cross-members 52, 54. Bottom plate 60 may be formed of one or more pieces of steel plate, with ½" thick plate being considered suitable in the context of the present invention.

Front portion 46 is provided with a pair of parallel guides 62, 64 fixed to the downwardly facing surface of bottom plate 60 and to the bottom wall surfaces of cross-members 52, 54. Guides 62, 64 extend in a longitudinal direction of skid assembly 30 and are spaced from one another by a distance corresponding to the width of a roll-off track of a transport vehicle, as will be described in greater detail below. A front extension 65 of each guide 62, 64 projects forward from cross-member 52 and cooperates with a corresponding yoke member 66 offset laterally inward therefrom in supporting an axle pin 67 to journal a roller 68 for rotation about a laterally extending axis. In the embodiment shown, rollers 68 are formed as cylindrical rollers and are arranged such that the downwardly facing surface of bottom plate 60 is substantially tangential to an underside of the roller. Guide extensions 65 may have an arcuate leading lower edge 69 for smooth engagement with rollers on a roll-off track of a transport vehicle, as will be described later herein. Gussets 71 welded to cross-member 52 and yoke members 66 may be used to provide added strength in supporting rollers 68. Front portion 46 of skid assembly 30 is also equipped with a cleat member 70, which is broadly intended to mean any suitable male member or female configuration used to connect a tension cable of a transport vehicle hoist mechanism to firebox apparatus 10. In the depicted embodiment, cleat member 70 is a hooked member welded to a top face of cross-member 52 midway between skid members 32, 34.

Rear portion 48 of skid assembly 30 includes a cross-member 72 having its opposite ends welded to the inner side faces of skid members 32, 34. Cross-member 72 may be fabricated from a length of 8" square steel tubing. A bottom plate 74 is welded at its lateral side edges to the inner side faces of skid members 32, 34, at its rear edge to a front face of cross-member 72, and at its front edge to a laterally extending spacing bar 76. Rear portion 48 further includes a platform 77 between skid members 32, 34. Platform 77 has a top plate 78 welded at its front edge to spacing bar 76 and at its rear edge to the front face of cross-member 72. Bottom plate 74 and top plate 78 may each be formed of one or more pieces of steel plate, such as ½" thick steel plate. In the embodiment now being described, the downwardly facing surface of bottom plate 60 of front portion 46 and the downwardly facing surface of bottom plate 74 of rear portion 48 are substantially coplanar.

Figure 4:
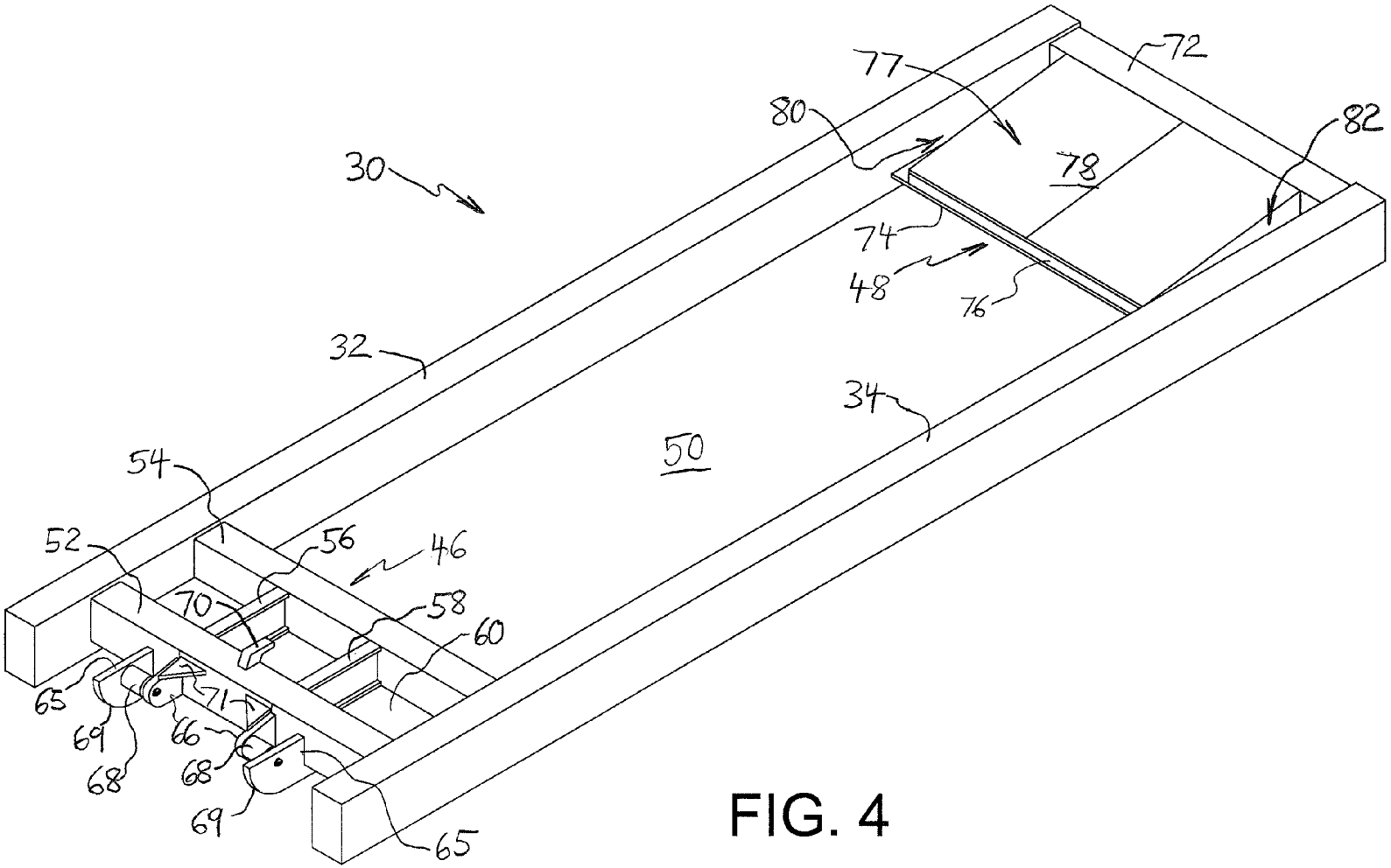
FIG. 4 is an orthogonal view of a supporting skid assembly of the firebox apparatus.

As best seen in FIG. 4, top plate 78 is tilted relative to horizontal, whereby platform 77 has an upper surface that is inclined upwardly as it extends in a direction from front to rear of skid assembly 30. The width (lateral extent) of top plate 78 is slightly less than the distance between opposing inner side faces of skid members 32, 34 such that clearance is provided between the sides of platform 77 and the inner faces of skid members 32, 34 to define a pair of longitudinally extending channels 80, 82. Channels 80, 82 each receive a rear refractory panels 20 of a respective side wall 13, 14 of firebox 12, such that bottom plate 74 of rear portion 48 provides additional support and stability to side walls 13, 14.

Skid assembly 30 may be equipped with a second pair of parallel guides 84, 86 fixed to the underside of rear portion 46 in alignment with the first pair of parallel guides 62, 64 fixed to the underside of front portion 46. Guides 84, 86 may be welded to the downwardly facing surface of bottom plate 74 and to the bottom face of cross-member 72.

In accordance with an embodiment of the present invention, guides 62, 64 and 84, 86, excluding guide extensions 65, are defined by steel angle segments having one leg welded in surface-to-surface engagement with an associated bottom plate 60 or 74 and another leg depending downwardly to provide a planar guide surface. The planar guide surfaces of guides 62, 64 are identified as 62A and 64A in FIGS. 5 and 6, while the planar guide surfaces of guides 84, 86 are identified as 84A and 86A in FIGS. 3 and 5. This configuration of guides 62, 64, 84, and 86 is easy to fabricate and provides reliable guidance as firebox apparatus 10 moves along a roll-off track of a transport vehicle.

Firebox apparatus 10 further comprises an air curtain system associated with firebox 12 for blowing air across the open top 18 of combustion chamber 17 to reduce the escape of particulates and byproducts into the atmosphere during incineration. As seen in FIG. 1, a control room 90 is provided atop front portion 46 of skid assembly 30 for housing a control unit 91, a blower 92 operatively connected to control unit 91, and a manifold 93 in communication with blower 92. Manifold 93 is arranged to extend along the top of longitudinal side wall 14, and serves to direct airflow across combustion chamber 17. A floor plate 94 may be provided in control room 90 atop cross-members 52, 54 and brace members 56, 58 to support control unit 91. The air curtain system may be constructed substantially as taught in U.S. Pat. No. 5,415,113 referenced above.

Figure 7:
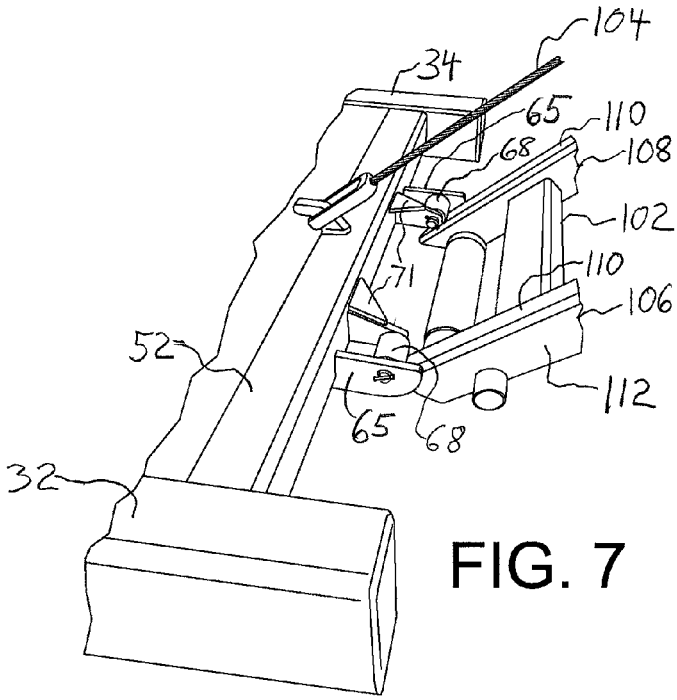
FIG. 7 is a perspective view showing alignment of a front portion of the skid assembly with a tiltable roll-off track of a transport vehicle.

Reference is made now to FIG. 7, which illustrates alignment of a front end of firebox apparatus 10 with a tiltable roll-off track 102 of a transport vehicle 100 (FIGS. 8A-8D) and attachment of a retractable tension cable 104 of the transport vehicle to the firebox apparatus 10. As will be understood, roll-off track 102 and tension cable 104 are parts of a conventional roll-off hoist mechanism 101 of transport vehicle 100. Roll-off track 102 may be progressively and reversibly is tilted by operation of a pair of hydraulic actuators acting between the vehicle chassis and a front end of the roll-off track 102 from a generally horizontal position to a fully tilted position wherein a rear end of track 102 engages the ground, as shown in FIG. 6. As may be seen, roll-off track 102 includes a pair of parallel siderails 106, 108 each having an upwardly facing surface 110 and an outwardly facing surface 112 (only one of the outwardly facing surfaces 112 being visible in FIG. 7). Rollers 68 are located for alignment with siderails 106, 108 and will engage upwardly facing surfaces 110 of the siderails during a roll-off or pick-up operation as described below. Guide surfaces 62A, 64A, 84A, and 86A will slideably engage outwardly facing surfaces 112 of siderails 106, 108 to guide firebox apparatus 10 as it travels in a longitudinal direction relative roll-off track 102.

It should be realized that other types of guides may be employed without straying from the invention. For example, guides which incorporate a series of rollers spaced longitudinally along a guide body for tangential rolling contact with a roll-off track may be used. Guides providing intermittent guide surfaces, rather than a continuous guide surface as shown, could also be used to reduce friction.

Figure 8A:
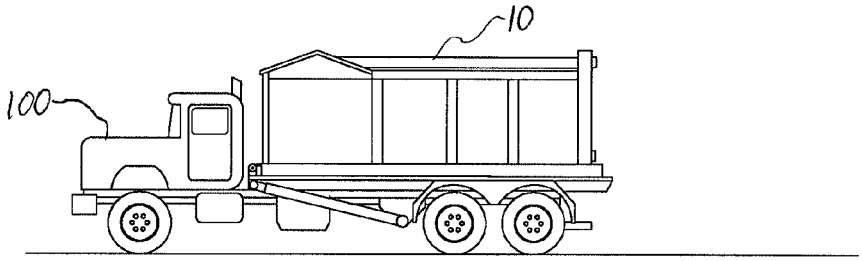
FIGS. 8A-8D are a series of side elevational views showing a roll-off firebox apparatus of the present invention being unloaded from a transport vehicle equipped with a hoist mechanism having a retractable tension cable and a tiltable roll-off track.
Figure 8B:
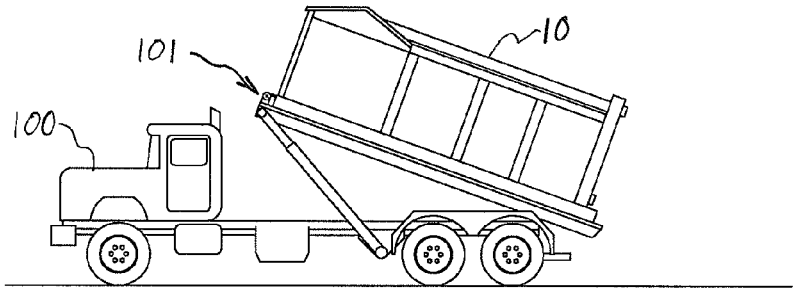
Figure 8C:
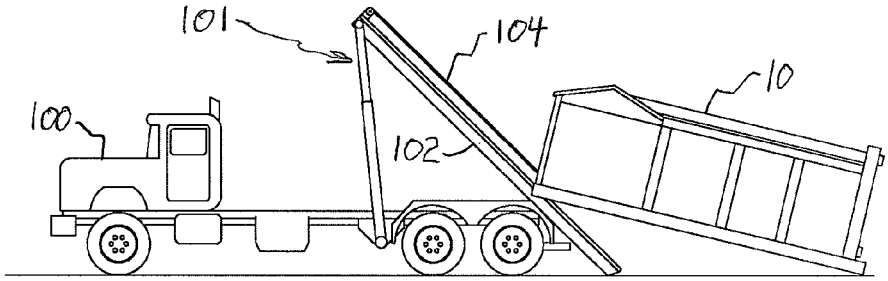
Figure 8D:
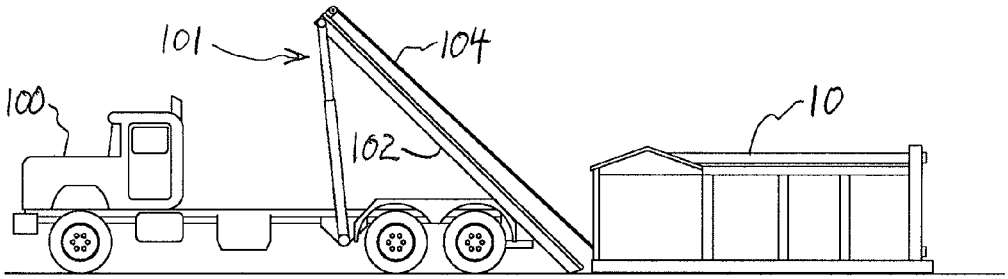

Loading and of firebox apparatus 10 onto a transport vehicle 100 and unloading of the firebox apparatus at an incineration site will now be described with reference to FIGS. 7 and 8A-8D. Loading is carried out by maneuvering transport vehicle 100 such that its rear end is adjacent a front end of firebox apparatus 10 and siderails 106, 108 of the transport vehicle's roll-off track 102 are aligned with rollers 68 and guides 62, 64. The hoist mechanism is adjusted to position roll-off track 102 in its fully-tilted position, and an attachment end of tension cable 104 is coupled to cleat member 70. Hoist mechanism 101 is then operated to progressively pull firebox apparatus 10 onto roll-off track 102 and lower the front end of roll-off track until firebox apparatus 10 rests in a horizontal position on roll-off track 102. Firebox apparatus may then be secured to transport vehicle 100 by conventional means and driven to an incineration cite. As may be understood from FIGS. 8A through 8D, firebox apparatus 10 may be unloaded from transport vehicle 100 in a substantially reverse manner, wherein gravity will aid the unloading process as the front end of roll-off track 102 is slowly raised. Once the rear end of firebox apparatus 10 firmly engages the ground as depicted in FIG. 8C, the transport vehicle 100 is slowly driven forward to allow the front end of the firebox apparatus to progress downward along tilted roll-off track 102 until the firebox apparatus is completely supported by the ground. Following unloading, tension cable 104 is detached from cleat member 70 and the firebox apparatus is ready for start-up and normal operation.

As will be appreciated from the foregoing description, the supporting skid assembly of firebox apparatus 10 distributes and supports loads applied to firebox apparatus 10 during unloading and loading with respect to transport vehicle 100, and guides the firebox apparatus as it moves along roll-off track 102. With the present invention, it is now possible to efficiently install and use environmentally friendly air-curtain incinerators in urban environments wherever and whenever the need arises.

What is claimed is:

1. A firebox apparatus comprising:

a firebox including a pair of laterally-spaced longitudinal side walls connected by a front wall and a rear wall to define a combustion chamber having an open bottom and an open top; and a frame for supporting the walls of the firebox, the frame including a skid assembly at a base of the frame, wherein the skid assembly includes at least one pair of laterally-spaced parallel guides arranged on an underside of the skid assembly for guiding longitudinally directed travel of the skid assembly, the pair of parallel guides being spaced from one another by a distance narrower than a lateral distance between the longitudinal side walls of the firebox;

wherein the skid assembly includes a pair of laterally-spaced longitudinal skid members connected by a front portion and a rear portion to define an internal opening registering with the open bottom of the combustion chamber, and the pair of skid members engage the ground when the firebox apparatus is situated at an incineration location;

wherein the skid assembly includes a bottom plate connecting the longitudinal skid members, and a platform above the bottom plate and between the longitudinal skid members, wherein the platform is spaced from each skid member to define a pair of longitudinally extending channels.

2. The firebox assembly according to claim 1, wherein the front portion of the skid assembly includes a pair of laterally-spaced cylindrical rollers journalled at a forward location of the front portion to rotate about a transverse axis.

3. A firebox apparatus for loading onto and unloading from a transport vehicle, the transport vehicle including a retractable tension cable and a tiltable roll-off track having a pair of parallel siderails each having an upwardly facing surface and an outwardly facing surface, the firebox apparatus comprising:

a firebox including a pair of laterally-spaced longitudinal side walls connected by a front wall and a rear wall to define a combustion chamber having an open bottom and an open top;

a frame for supporting the walls of the firebox, the frame including a skid assembly at a base of the frame, wherein the skid assembly includes a pair of laterally-spaced longitudinal skid members connected by a front portion and a rear portion to define an internal opening registering with the open bottom of the combustion chamber, and a pair of parallel guides fixed to at least one of the front portion and the rear portion for guiding the firebox apparatus as the firebox apparatus travels in a longitudinal direction relative to the roll-off track of the transport vehicle;

wherein a first pair of parallel guides are fixed to the front portion of the skid assembly and a second pair of parallel guides are fixed to the rear portion of the skid assembly;

wherein the first pair of parallel guides and the second pair of parallel guides have a flat guide surface for slideable engagement with the respective outwardly facing surface of the siderail;

wherein the first pair of parallel guides and the second pair of parallel guides are defined by a pair of steel angle segments, the steel angle segments having a reinforcing member so that the first pair of parallel guides and the second pair of parallel guides have a triangular cross-section; and wherein the rear portion of the skid assembly includes a bottom plate connecting the longitudinal skid members, and a platform above the bottom plate and between the longitudinal skid members, wherein the platform is spaced from each skid member to define a pair of longitudinally extending channels.

4. The firebox apparatus according to claim 3, wherein the front portion of the skid assembly includes at least one roller journalled at a forward location of the front portion to rotate about a transverse axis, the at least one roller being arranged to engage the upwardly facing surfaces of the pair of siderails as the firebox apparatus is pulled into initial contact with the roll-off track by the tension cable.

5. The firebox apparatus according to claim 4, wherein the at least one roller includes a pair of rollers arranged to respectively engage the upwardly facing surfaces of the pair of siderails.

6. The firebox apparatus according to claim 5, wherein the front portion of the skid assembly further includes a downwardly facing bottom surface trailing behind the pair of rollers for slideably engaging the upwardly facing surfaces of the pair of siderails.

7. The firebox apparatus according to claim 6, wherein the pair of rollers are cylindrical rollers, and the bottom surface of the front portion of the skid assembly is in a plane tangential to an underside of the cylindrical rollers.

8. The firebox apparatus according to claim 3, wherein each of the guides of the rear portion has a flat guide surface coplanar with one of the flat guide surfaces of the front portion.

9. The firebox apparatus according to claim 8, wherein the rear portion of the skid assembly further includes a downwardly facing bottom surface, and the guides of the rear portion are defined by a pair of steel angle segments each fixed to the bottom surface of the rear portion.

10. The firebox apparatus according to claim 3, wherein each longitudinal side wall of the firebox includes a refractory panel received by a respective one of the longitudinally extending channels.

11. The firebox apparatus according to claim 3, wherein the platform includes an upper surface inclined upwardly in a direction from front to rear of the skid assembly.

12. The firebox apparatus according to claim 3, further comprising an air curtain system associated with the firebox for blowing air across the open top of the combustion chamber.

13. The firebox apparatus according to claim 3, wherein the skid assembly includes at least one cleat member for use in attaching the tension cable of the transport vehicle to the skid assembly.

* * * * *